US006672364B2

(12) United States Patent
Yoshii

(10) Patent No.: US 6,672,364 B2
(45) Date of Patent: Jan. 6, 2004

(54) CURTAIN STRUCTURAL FORM AND CURTAIN STRUCTURAL FORM HAVING PLEATS

(75) Inventor: Mitsuo Yoshii, Tokyo (JP)

(73) Assignee: Clean Text Inc., Tokyo (JP)

( * ) Notice: Subject to any disclaimer, the term of this patent is extended or adjusted under 35 U.S.C. 154(b) by 1 day.

(21) Appl. No.: 10/177,136

(22) Filed: Jun. 24, 2002

(65) Prior Publication Data

US 2003/0226647 A1 Dec. 11, 2003

(30) Foreign Application Priority Data

Jun. 7, 2002 (JP) ..... 2002-167336

(51) Int. Cl.[7] ..... A47H 13/14
(52) U.S. Cl. ..... 160/348
(58) Field of Search ..... 160/348, 330, 160/340, 341, 123, 126, 405; 16/87 R, 87.2

(56) References Cited

U.S. PATENT DOCUMENTS 2,621,728 A * 12/1952 Anderson ..... 160/348
2,672,194 A * 3/1954 Loudon ..... 160/348
2,796,928 A * 6/1957 Bernhard et al. ..... 160/348
2,864,442 A * 12/1958 Murgolo ..... 160/348

FOREIGN PATENT DOCUMENTS

JP 57-188215 11/1982

* cited by examiner

*Primary Examiner*—David Purol
(74) *Attorney, Agent, or Firm*—Wenderoth, Lind & Ponack L.L.P.

(57) ABSTRACT

A curtain structure comprises:

(1) clips, each of which has a U-shaped connection section, a reversed U-shaped connection section and a rectangularly-shaped engagement section which, are consecutively formed, and co-planar with one another, from a base portion to a portion formed to grip a suspension ring of a curtain liner, and (2) a tape member to be positioned at an upper edge portion of a curtain and having pockets or bag-shaped supports in which the rectangular-shaped engagement sections of the clips can be inserted from a lower side, with the pockets or bag-shaped supports being integrated with the tape member by combined weaving. The clips are inserted in the tape member, with the tape member being sewn together with a curtain member. The curtain structure may be a pleatable curtain structure, wherein each combination of adjacent two clips forming a pair at an upper edge portion of the curtain have a distance therebetween that is sufficient for forming a pleat when the two clips are attached to the tape member and suspended from one suspension ring of a curtain liner.

25 Claims, 7 Drawing Sheets

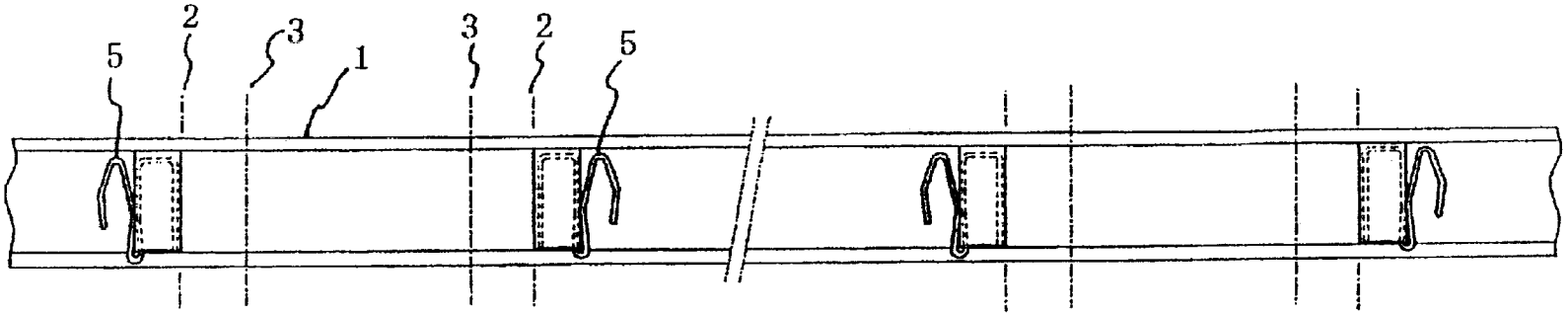
FIG. 6—A
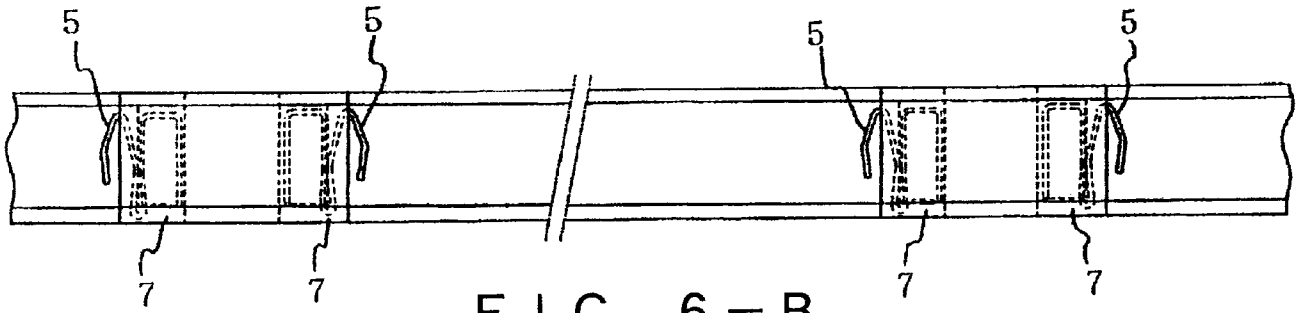
FIG. 6—B
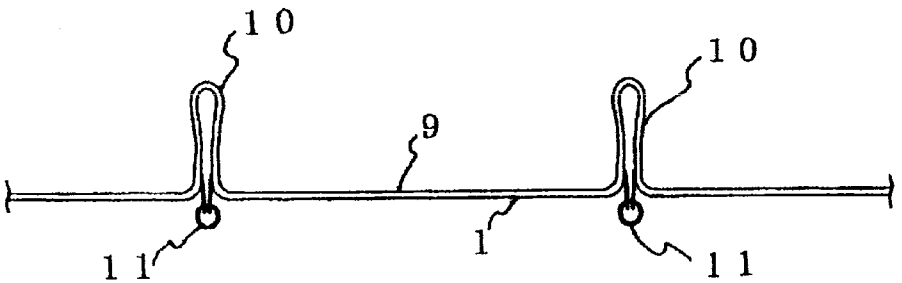
FIG. 6—C

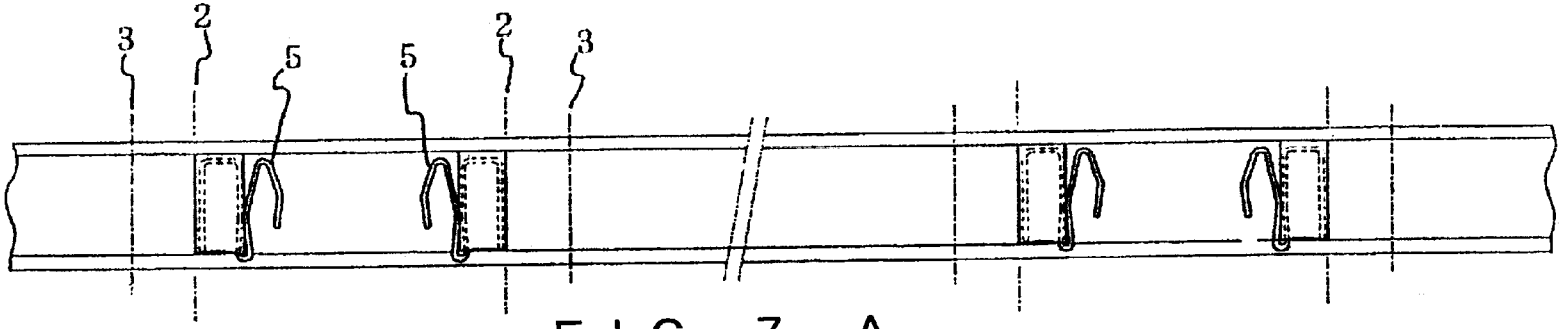
FIG. 7—A
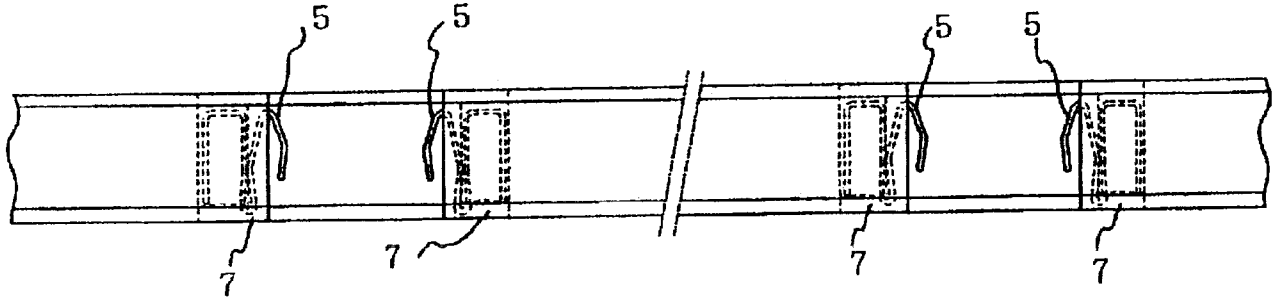
FIG. 7—B
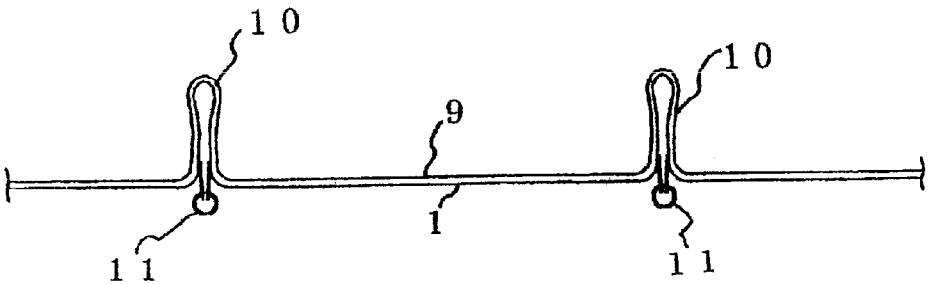
FIG. 7—C

CURTAIN STRUCTURAL FORM AND CURTAIN STRUCTURAL FORM HAVING PLEATS

FIELD OF THE INVENTION

The present invention relates to a curtain structure in which a clip for allowing a curtain to suspend from a suspension ring of a curtain liner has a specific form and is attached to the curtain by specific structure. More specifically, the present invention relates to a curtain structure in which a specifically formed clip is attached to a curtain in parallel to the curtain above a curtain surface and in a non-upright manner. Further, the present invention relates to a pleatable curtain structure.

RELATED PRIOR ART

When a clip is attached to a curtain, conventionally, there is employed a method in which an upper marginal portion of the curtain is partly self-overlapped and sewn together to form a pleat portion first, and an upright section of a clip is inserted into a joint of the pleat portion from below. During attachment of a clip according to the above method, however, a gripping section of the clip, formed to engage with a suspension ring of a curtain liner, is brought into a state where the gripping section stands upright and projects from a curtain surface. When the above curtain is cleaned in a state where the curtain has such clips attached thereto, the clips hinder and cause various difficulties. Before cleaning, therefore, it is conventional practice to remove the clips from a curtain, which is very troublesome. Particularly, when a large volume of curtains, like curtains to lease, is cleaned at once, it is impossible to dry the curtains having the clips attached thereto, with a so-called heat roll, and efficiency of work is caused to decrease. Furthermore, with the above attachment structure, the clip comes into point-contact with a seam of the above pleat-forming portion, so that weight of the curtain is exerted collectively on the seam. There are therefore drawbacks in that the seam is easily opened and that the attachment structure is destroyed before long.

For overcoming the above drawbacks, JP-A-57-188215 proposes a method of attaching a clip, in which the clip does not stand upright from a curtain surface but comes into a state parallel thereto, and a lower portion of the clip removed from a suspension rings of a curtain liner is embedded in a curtain surface, so that the clip does not create a hinderance during cleaning.

In the above known method, an engagement section of the clip has a relatively small U form and is engaged with a margin of a cylindrical support of a tape by sewing, so that the clip is sometimes broken and comes off when an excess load is exerted on a curtain.

SUMMARY OF THE INVENTION

It is therefore an object of the present invention to provide a curtain structure in which a clip having a specific form is attached to a curtain member with a specific structure such that the clip does not create a hinderance when the curtain with the clip attached thereto is cleaned in a laundry, and such that the clip does not come off under an excess load.

According to the present invention, the object of the present invention is to provide a curtain structure having a curtain clip and its attachment structure, which are characterized by the following (1) to (4);

(1) clips, each of which has a U-shaped connection section, a reversed U-shaped connection section, and a rectangulary-shaped engagement section, which are consecutively formed so as to be co-planar with one another from a base portion to a portion formed to grip a suspension ring of a curtain liner, (2) a tape member is positioned at an upper edge portion of a curtain and has pockets or bag-shaped supports in which the rectangularly-shaped engagement sections of the clips can be inserted from a lower side, with the pockets or bag-shaped supports being integrated with the tape member by combined weaving, (3) the clips are engaged with the pockets or bag-shaped supports of the tape member in a state where the rectangularly-shaped engagement sections of the clips are inserted into the pockets or bag-shaped supports from a lower portion and a top of a gripping portion of each clip faces downwardly, and (4) the tape member of the curtain is folded so as to cover the pockets or bag-shaped supports with which the rectangularly-shaped engagement sections are engaged, and so as to expose ordinary gripping portions of the U-shaped connection sections of the clips, with upper portions of folded portions being sewn together, and lower portions of the folded portions being sewn together.

According to the curtain structure of the present invention, the clips that are attached to a curtain do not cause any hindrance during steps of washing for cleaning, drying with a heat roll, and pressing. Since the clips are firmly inserted in the pockets or bag-shaped supports integrated with the tape member by combined weaving, the clips are fixed in parallel to the tape member, and further, even when a strong load is exerted on the curtain, the clips have strength sufficient for withstanding such a load. Further, the curtain structure of the present invention has simplicity, in that the clips can be attached to the tape member by a simple operation of inserting the clips into the pockets or bag-shaped supports of the tape member.

Further, the present inventor has continued studies for a manner of easily forming a pleat in a curtain when the above curtain structure of the present invention is attached to a curtain liner, and there can be accordingly provided a pleated curtain structure as follows.

According to the present invention, therefore, there is provided a curtain structure that is the above curtain structure and that has a pleat, in which two clips forming a pair in a tape member at an upper edge portion of a curtain have a distance therebetween that is sufficient for forming a pleat when the two clips are attached to the tape member and suspended from one suspension ring of a curtain liner.

BRIEF DESCRIPTION OF DRAWINGS

FIG. 6A shows a front view of a tape member in a state where a pair of adjacent clips for a pleated curtain structure are attached to a tape member.

FIG. 6B shows a front view of the tape member of FIG. 6A in a folded state.

FIG. 6C is a top view of a curtain structure in which a pair of clips are allowed to grip one suspension ring of a curtain liner.

FIG. 7A shows a front view of a tape member in a state where a pair of adjacent clips for a pleated curtain structure are attached to a tape member.

FIG. 7B shows a front view of the tape member of FIG. 7A in a folded state.

FIG. 7C is a top view of a curtain structure in which a pair of clips are allowed to grip one suspension ring of a curtain liner.

Explantation of Symbols

1 Tape member

2 Fold line

3 Fold line

4 Pocket or Bag-shaped support

4*a* Clip insertion slot

5 Clip

5*a* shaped connection section of clip

5*b* Reversed shaped connection section of clip

5*c* Rectangularly-shaped engagement section of clip

6 Combined weave portion of tape member

7 Folding (folded) portion

8 Sites that are sewn together

9 Curtain

10 Pleat

11 Suspension ring of curtain linear

DETAILED DESCRIPTION OF THE PREFERRED EMBODIMENTS

A curtain structure of the present invention will be more specifically explained hereinafter with reference to drawings.

Figure 1:
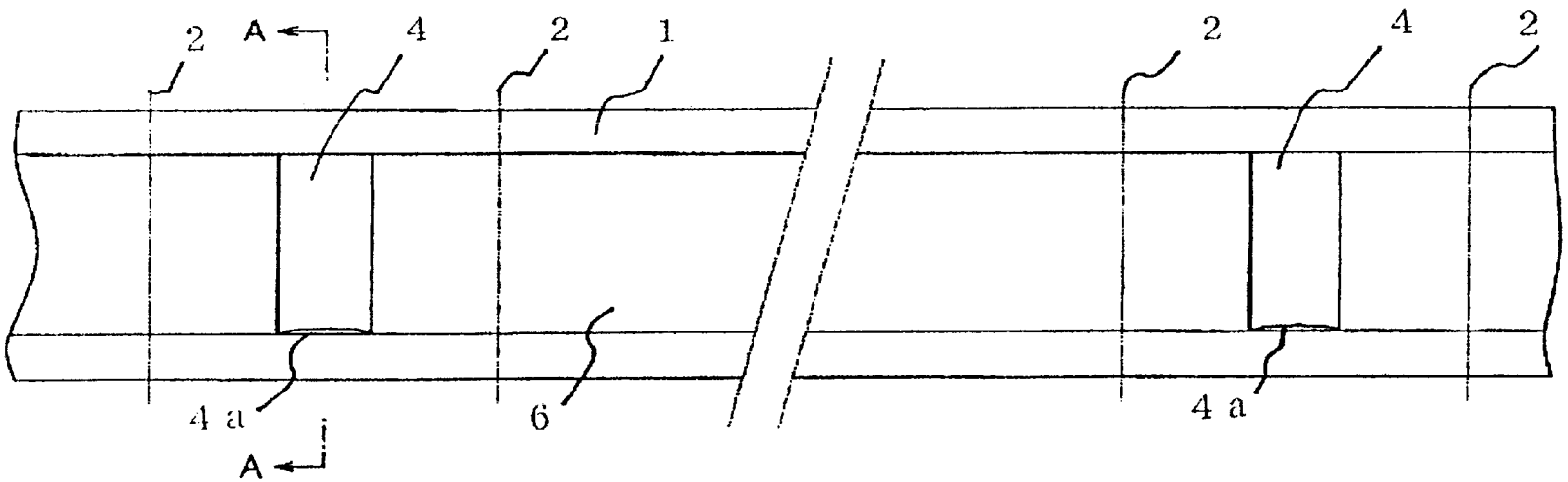
FIG. 1 shows a front view of a tape member at an upper edge portion a curtain in of the present invention.

FIG. 1 shows a front view of a tape member 1 at an upper edge portion of a curtain. The tape member has a pocket or bag-shaped support 4 formed by combined weaving. The pocket or bag-shaped support has an insertion slot 4*a* through which a clip can be inserted from a lower side and is generally in the form of a rectangular cylinder. The pocket or bag-shaped support 4 is woven to combine it with the tape member, and has a form that permits firm insertion of the a rectangularly-shaped engagement section of a clip. Specifically, a width of the rectangularly-shaped engagement section of the clip is substantially equal to a width of the pocket or bag-shaped support. Therefore, the bag-shaped support makes it easy to attach a clip thereto, and serves to maintain the tape member 1 in a flat state after the clip is attached, and the pocket or bag shaped support can also stand a load of an excess weight.

The tape member 1 is preferably constituted of a synthetic fiber such as a polyester fiber or a nylon fiber, and a polyester fiber is particularly preferred.

Figure 2:
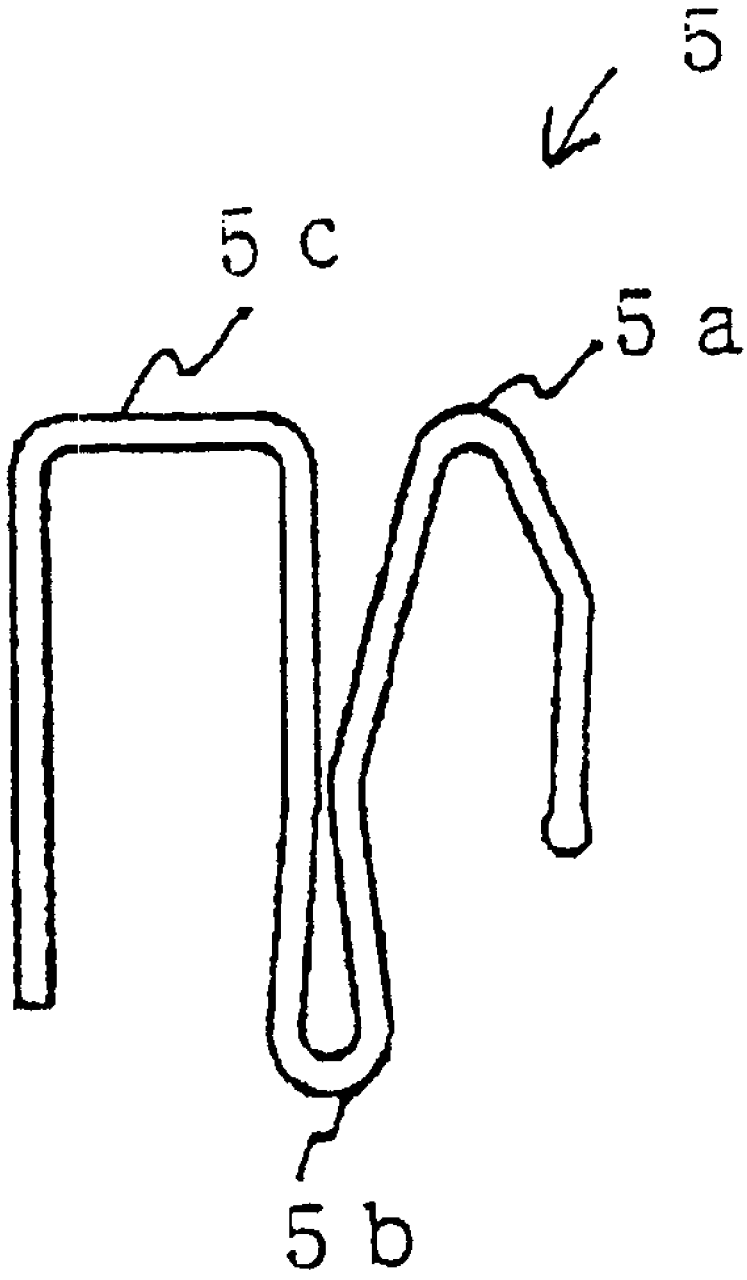
FIG. 2 shows an enlarged front view of one example of a clip of the present invention.

As shown in FIG. 2, a clip 5 of the present invention has a structure in which a U-shaped connection section 5*a*, a reversed U-shaped connection section 5*b*, and a rectangularly-shaped engagement section 5*c* are consecutively provided, and co-planar with one another, from a lower portion side of a section for gripping a suspension ring of a curtain liner. While the clip 5 may be formed of a plastic, it is preferably formed of a metal in view of strength, ease of production and cost.

The clip 5 of the present invention has a characteristic feature in that the engagement section 5*c* has a rectangular shape (one-side free rectangular such as the shape of ⊐). Due to the rectangular shape, the clip 5 can be firmly fixed to the tape member so that a flat surface is formed and the clip no longer stands upright from the tape member. Desirably, the rectangularly-shaped portion has an area that is approximately 50% of an area which the clip occupies in its entirety. Further, the rectangularly-shaped portion preferably has a vertical portion:horizontal portion length ratio of 2:1. Further, a top portion of U-shaped connection section 5*a* of the clip 5 preferably has a round head portion, which is preferred for smoothly carrying out operations when a curtain is cleaned or the clip is hung on a suspension ring of a curtain liner.

The rectangularly-shaped engagement section 5*c* of the clip 5 is inserted into the pocket or bag-shaped support 4 of the tape member, whereby the engagement section 5*c* is advantageous to bring sizes and forms of the engagement section 5*c* and the pocket or bag-shaped support into agreement such that these two members have almost no degree of freedom when the rectangularly-shaped engagement section 5*c* is inserted into the bag-shaped support.

Figure 3:
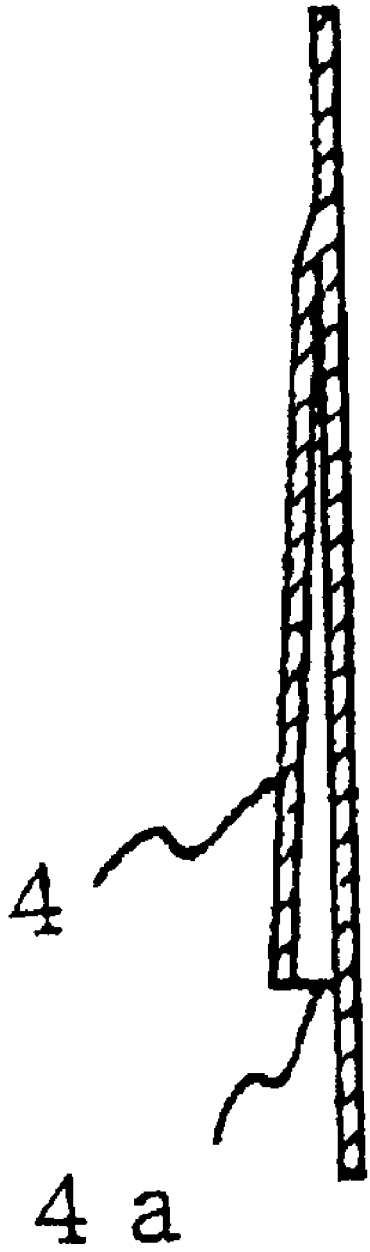
FIG. 3 is an enlarged view of a cross section taken along A—A in the tape member in FIG. 1.

FIG. 3 shows an enlarged view of A—A cross section of the pocket or bag-shaped support 4 of the tape member 1 shown in FIG. 1. A lower portion 4*a* of the pocket or bag-shaped support 4 is an insertion slot. A circumferential portion of the pocket or bag-shaped support has an integrated structure formed by combined weaving with the tape member 1 except for the insertion slot 4*a*.

Figure 4:
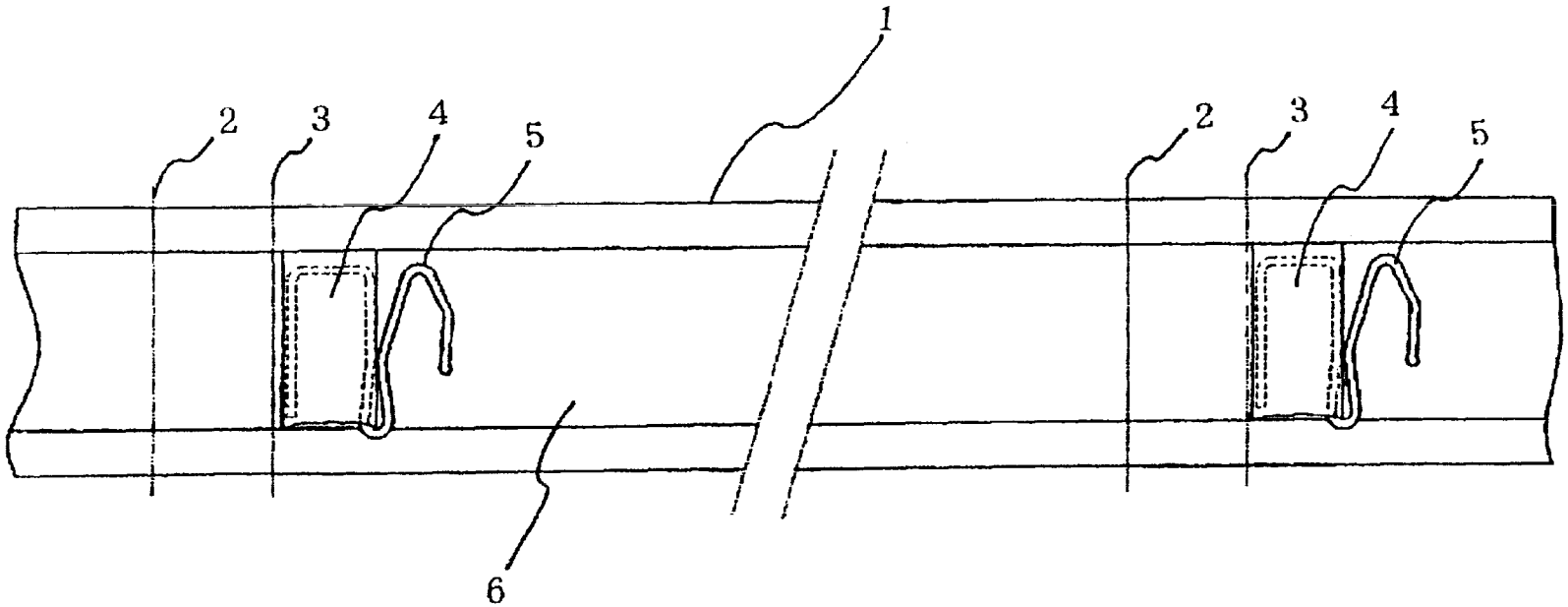
FIG. 4 shows a front view of the tape member in a state where clips are inserted into pockets or bag-shaped support portions of the tape member from a lower side and engaged therein.

FIG. 4 shows a state where the clip 5 is inserted into the pocket or bag-shaped support 4 of the tape member 1. Generally, clips 5 are inserted into pockets or bag-shaped supports 4 of the tape member 1 such that shaped connection sections 5*c* of the clips 5 face in the same direction as shown in FIG. 4, although such is not necessarily required.

Figure 5:
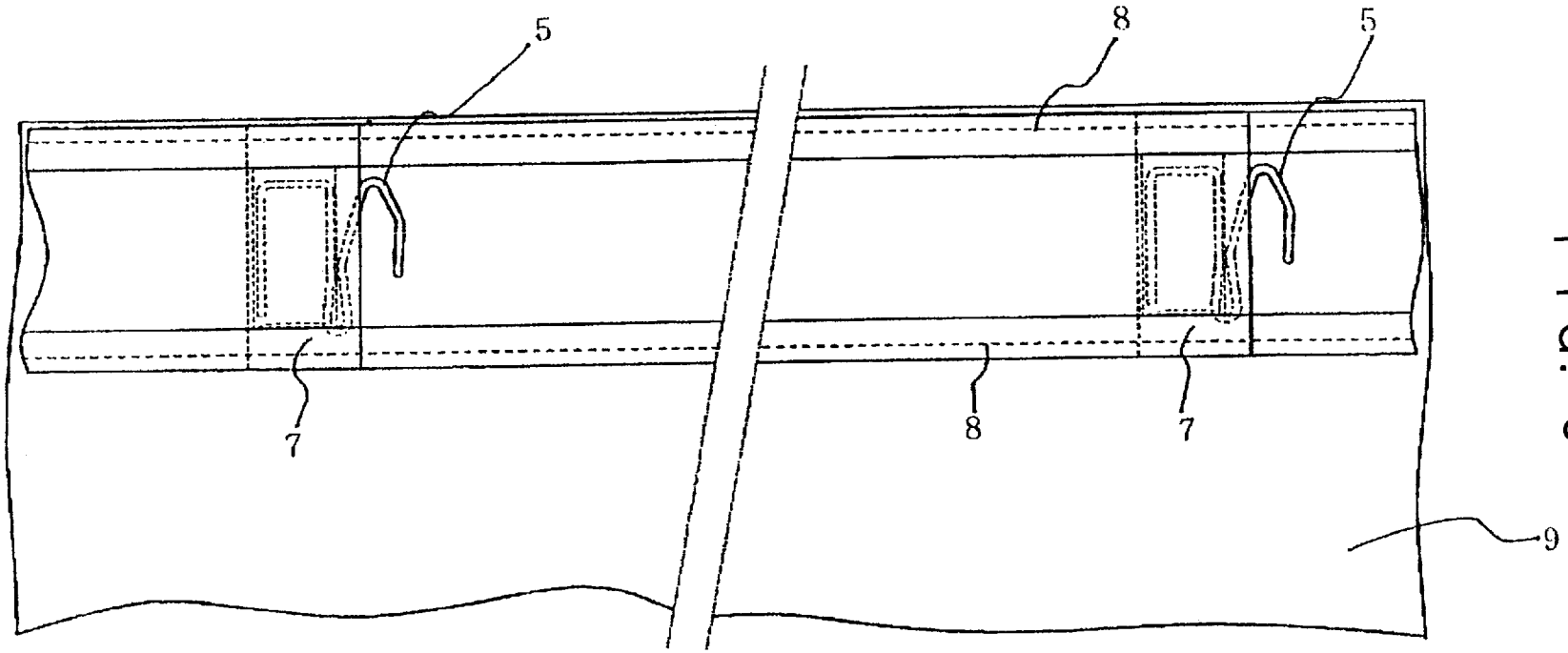
FIG. 5 is a front view of a tape member in a state where the tape member is folded such that an ordinary gripping portion of a shaped connection portion of a clip is exposed.

FIG. 5 shows a state where the clips 5 are inserted into the pockets or bag-shaped supports 4 of the tape member 1, the tape member is folded, and an upper margin and a lower margin of folded portions of the tape member are respectively sewn together. In FIGS. 1 and 4, fold lines of the tape member 1 are indicated by numerals 2 and 3. It is because a fold line is changed in position depending upon a direction in which the clip 5 is attached that the fold lines 2 are shown in two places, one each in positions left and right of the pocket or bag-shaped support in FIG. 1.

When the tape member 1 is folded as shown in FIG. 5, the tape member 1 in FIG. 4 can be folded such that the fold line 3 faces inwardly and the fold line 2 faces outwardly.

When the tape member 1 is folded as shown in FIG. 5, preferably, the fold line 2 is positioned nearly at a center of the shaped connection section 5*a* such that the an ordinary gripping portion of the shaped connection section of the clip 5 is exposed. Numerals 8 indicate sewing portions at the upper and lower margins of the folded portions of the tape member.

The sewing portions 8 in FIG. 5, in addition to indicating where folded portions of the tape member are sewn together, also indicate portions where the tape member 1 and a curtain member are sewn together.

An embodiment for forming pleats (puckers) in the above curtain structure of the present invention will be explained below.

A pleated curtain structure of the present invention has characteristic features in the form of a clip, structure by which the clip is attached to a tape member, and a manner by which a pair of clips for forming a pleat are attached to the tape member. Further, the pleated curtain structure also has a characteristic feature of inserting clips into suspension rings of a curtain liner so that many pleats are formed when the curtain structure is attached to the curtain liner. These characteristic features of the present invention will be explained below with reference to drawings.

FIG. 6A shows a front view of tape member 1, in which pairs of adjacent clips are attached to the tape member 1 in a pleated curtain structure. Two clips 5 on the left hand side in FIG. 6A show a pair of the clips. These two clips are inserted into pockets or bag-shaped supports 4 of the tape member 1, one each, such that a gripping portion (U-shaped connection section 5*a*) of one of the clips faces opposite to a gripping portion of the other of the clips, and the tape member 1 is folded such that the gripping portions of the clips 5 are exposed as shown in FIG. 6B. Pairs of the clips are attached to the tape member so as to form many pairs as shown in FIG. 6B (FIG. 6B shows two pairs). While the tape member and the curtain member are sewn together, a showing of the curtain member is omitted in FIG. 6B. FIG. 6C schematically shows a top view of the curtain structure in which the curtain structure is attached to suspension rings of a curtain liner. In FIG. 6C, a pair of the clips are suspended with one suspension ring 11 of a curtain liner to form a pleat 10 in a curtain. Pairs of such clips are attached to a tape member at intervals of a nearly constant distance so as to form many pleats 10. While the distance between two clips forming a pair is determined depending upon a height of a pleat (pucker) 10, this distance is desirably set such that the pleat (pucker) is generally 20 to 70 mm high, preferably 25 to 60 mm high. A distance between two clips forming a pair is therefore approximately twice as large as a desired height of a pleat.

FIG. 7A is a front view of a tape member, in a state where clips of a pleated curtain structure are attached to the tape member nearly as shown in FIG. 6. FIG. 7B shows a front view of the tape member, in a state where the tape member shown in FIG. 7A is folded. FIG. 7C shows a top view of the curtain structure that is in a state of suspension from a curtain liner. The curtain structure in FIG. 7 differs from that in FIG. 6 in that gripping portions of clips forming a pair face each other inwardly. Directions of the gripping portions of a pair of the clips, facing opposite to each other (FIG. 6) or facing each other (FIG. 7), do not cause any essential difference in formation of a pleat.

The curtain structure of the present invention has the following advantages and effects.

(1) Owing to a combination of the structure of the clips and the structure of the tape member in which the clips are inserted, attaching the clips is simple and the curtain structure can withstand a load on the curtain member.

(2) Pleats can be easily formed in the curtain by attaching the curtain structure to a curtain liner, and the curtain structure can be simply attached and detached.

(3) The clips do not cause any hindrance during a cleaning operation (washing, drying and pressing), and pleated portions are spread, so that the curtain structure can be dried and pressed with a heat roll.

(4) When the curtain structure is used, pleats are formed, so that the curtain provides an excellent aesthetic sense, design and high-class sense.

What is claimed is:

1. A curtain structure comprising: at least one clip having (i) a U-shaped connection section, (ii) a reversed U-shaped connection section, and (iii) a rectangularly-shaped engagement section, wherein said U-shaped connection section, said reversed U-shaped connection section, and said rectangularly-shaped engagement section are co-planar with one another and define a base portion and a gripping portion that is to grip a suspension ring of a curtain liner; and a tape member to be attached to an upper edge portion of a curtain, said tape member having at least one pocket to receive therein from a lower side thereof said base portion such that said gripping portion faces downwardly when said tape member is attached to the upper edge of the curtain and said gripping portion grips the suspension ring of the curtain liner.

2. The curtain structure according to claim 1, wherein said tape member includes a folded portion that covers said at least one pocket but does not cover said gripping portion when said base portion is received within said at least one pocket, with said folded portion being defined by a first portion of said tape member that is superposed a second portion of said tape member, wherein an upper portion of said first portion is sewn to an upper portion of said second portion and a lower portion of said first portion is sewn to a lower portion of said second portion.

3. The curtain structure according to claim 2, wherein said folded portion is further defined by a third portion of said tape member that is superposed said first portion of said tape member, with an upper portion of said third portion being sewn to an upper portion of said first portion and an upper portion of said second portion and a lower portion of said third portion being sewn to a lower portion of said first portion and a lower portion of said second portion.

4. The curtain structure according to claim 3, wherein said reversed U-shaped connection section is between said rectangularly-shaped engagement section and said U-shaped connection section, and said base portion is defined by said rectangularly-shaped engagement section and said gripping portion is defined by said U-shaped connection section.

5. The curtain structure according to claim 4, wherein said at least one clip comprises plural clips and said at least one pocket comprises plural pockets, with said rectangularly-shaped engagement section of each of said plural clips being receivable within a corresponding one of said plural pockets.

6. The curtain structure according to claim 5, wherein each of said plural pockets is defined by a support member that is woven to said tape member.

7. The curtain structure according to claim 6, wherein a width of said rectangularly-shaped engagement section of said each of said plural clips is substantially equal to a width of said corresponding one of said plural pockets.

8. The curtain structure according to claim 6, wherein said plural clips comprise plural metal clips.

9. The curtain structure according to claim 6, wherein said tape member comprises a polyester fiber tape member.

10. The curtain structure according to claim 6, wherein a distance between every two of said plural pockets is sufficient for forming a pleat in the curtain when said tape member is attached to the curtain, said rectangularly-shaped engagement section of said each of said plural clips is received in said corresponding one of said plural pockets, and adjacent ones of said plural clips are suspended from one extension ring of the curtain liner.

11. The curtain structure according to claim 10, wherein said plural clips and said plural pockets are constructed and arranged such that when said rectangularly-shaped engagement section of said each of said plural clips is received in said corresponding one of said plural pockets, and before said adjacent ones of said plural clips are suspended from the one extension ring of the curtain liner, respective U-shaped connection sections of said adjacent ones of said plural clips face each other.

12. The curtain structure according to claim 10, wherein said plural clips and said plural pockets are constructed and arranged such that when said rectangularly-shaped engagement section of said each of said plural clips is received in said corresponding one of said plural pockets, and before said adjacent ones of said plural clips are suspended from the one extension ring of the curtain liner, respective U-shaped connection sections of said adjacent ones of said plural clips face away from each.

13. The curtain structure according to claim 10, wherein said distance between every two of said plural pockets is sufficient for forming pleats at constant intervals when said rectangularly-shaped engagement section of said each of said plural clips is received in said corresponding one of said plural pockets, and said adjacent ones of said plural clips are suspended from the one extension ring of the curtain liner while additional adjacent ones of said plural clips are suspended from another extension ring.

14. The curtain structure according to claim 10, wherein said plural clips and said plural pockets are constructed and arranged such that when said tape member is attached to the curtain, said rectangularly shaped engagement section of said each of said plural clips is received in said corresponding one of said plural pockets, and after said adjacent ones of said plural clips are removed from the one extension ring of the curtain liner, the pleat can be removed by moving said adjacent ones of said plural clips away from each other.

15. The curtain structure according to claim 10, wherein said distance between every two of said plural pockets is sufficient for forming a pleat having a height of from 20 mm to 70 mm when said rectangularly shaped engagement section of said each of said plural clips is received in said corresponding one of said plural pockets, and said adjacent ones of said plural clips are suspended from the one extension ring of the curtain liner.

16. A method of pleating a curtain, comprising:

inserting a first clip into a first pocket of a tape member that is attached to a curtain;

inserting a second clip into a second pocket of said tape member; and suspending said first clip and said second clip from one curtain ring, wherein (a) said first clip and said second clip each include (i) a U-shaped connection section, (ii) a reversed U-shaped connection section, and (iii) a rectangularly-shaped engagement section, with said U-shaped connection section, said reversed U-shaped connection section, and said rectangularly-shaped engagement section being co-planar with one another and defining a base portion and a gripping portion, (b) inserting a first clip into a first pocket of a tape member that is attached to a curtain comprises inserting said base portion of said first clip into said first pocket, (c) inserting a second clip into a second pocket of said tape member comprises inserting said base portion of said second clip into said second pocket, and (d) suspending said first clip and said second clip from one curtain ring comprises engaging said gripping portion of said first clip and said gripping portion of said second clip with said one curtain ring.

17. The method according to claim 16, wherein inserting said base portion of said first clip into said first pocket comprises inserting said base portion of said first clip into said first pocket from a lower side of said first pocket such that said gripping portion of said first clip faces downwardly when said first clip is suspended from said one curtain ring, and inserting said base portion of said second clip into said second pocket comprises inserting said base portion of said second clip into said second pocket from a lower side of said second pocket such that said gripping portion of said second clip faces downwardly when said second clip is suspended from said one curtain ring.

18. The method according to claim 17, wherein said base portion is defined by said rectangularly-shaped engagement portion and said gripping portion is defined by said U-shaped connection section, such that inserting said base portion of said first clip into said first pocket and inserting said base portion of said second clip into said second pocket comprises inserting said rectangularly-shaped engagement section of said first clip into said first pocket and inserting said rectangularly-shaped engagement section of said second clip into said second pocket, and such that engaging said gripping portion of said first clip and said gripping portion of said second clip with said one curtain ring comprises engaging said U-shaped connection section of said first clip and said U-shaped connection section of said second clip with said one curtain ring.

19. The method according to claim 18, wherein said tape member is attached to an upper edge portion of said curtain.

20. The method according to claim 19, wherein engaging said U-shaped connection section of said first clip and said U-shaped connection section of said second clip with said one curtain ring comprises engaging said U-shaped connection section of said first clip and said U-shaped connection section of said second clip with a curtain ring of a curtain liner.

21. The method according to claim 20, further comprising:

forming a first folded portion of said tape member that covers said first pocket but does not cover said U-shaped connection section of said first clip when said rectangularly-shaped engagement section of said first clip is inserted within said first pocket, and forming a second folded portion of said tape member that covers said second pocket but does not cover said U-shaped connection section of said second clip when said rectangularly-shaped engagement section of said second clip is inserted within said second pocket, wherein forming said first folded portion comprises superposing a first portion of said tape member and a second portion of said tape member, and then sewing an upper portion of said first portion to an upper portion of said second portion and sewing a lower portion of said first portion to a lower portion of said second portion, and wherein forming said second folded portion comprises superposing a third portion of said tape member and a fourth portion of said tape member, and then sewing an upper portion of said third portion to an upper portion of said fourth portion and sewing a lower portion of said third portion to a lower portion of said fourth portion.

22. The method according to claim 21, wherein forming said first folded portion further comprises superposing a fifth portion of said tape member and said first portion of said tape member, and then sewing an upper portion of said fifth portion to said upper portion of said first and second portions and sewing a lower portion of said fifth portion to said lower portion of said first and second portions, and forming said second folded portion further comprises superposing a sixth portion of said tape member and said third portion of said tape member, and then sewing an upper portion of said sixth portion to said upper portion of said third and fourth portions and sewing a lower portion of said sixth portion to said lower portion of said third and fourth portions.

23. A method of pleating a curtain, comprising:

inserting plural clips into respective plural pockets of a tape member that is attached to an upper edge of a curtain; and suspending pairs of adjacent ones of said plural clips from respective curtain rings of a curtain liner, wherein each of said plural clips include (i) a U-shaped connection section, (ii) a reversed U-shaped connection section, and (iii) a rectangularly-shaped engagement section, with said U-shaped connection section, said reversed U-shaped connection section, and said rectangularly-shaped engagement section being co-planar with one another, such that inserting said plural clips into said respective plural pockets comprises inserting said rectangularly-shaped engagement section of each of said plural clips into a corresponding one of said respective plural pockets from a lower side thereof with said reversed U-shaped connection section of a respective each of said plural clips facing downwardly, and such that suspending pairs of adjacent ones of said plural clips from respective curtain rings comprises engaging said U-shaped connection section of each of two adjacent ones of said plural clips from one of said respective curtain rings.

24. The method according to claim 23, further comprising:

forming folded portions of said tape member that cover said respective plural pockets, respectively, but do not cover said U-shaped connection sections of respective ones of said plural clips, respectively, when said rectangularly-shaped engagement sections of said respective ones of said plural clips are inserted within said respective plural pockets, respectively, wherein forming said folded portions comprises superposing first portions of said tape member and second portions of said tape member, respectively, and then sewing upper portions of said first portions to upper portions of said second portions, respectively, and sewing lower portions of said first portions to lower portions of said second portions, respectively.

25. The method according to claim 24, wherein forming said folded portions further comprises superposing third portions of said tape member and said first portions of said tape member, respectively, and then sewing upper portions of said third portions to said upper portions of said first and second portions, respectively, and sewing lower portions of said third portions to said lower portions of said first and second portions, respectively.

* * * * *